US007281988B2

(12) United States Patent
Hou

(10) Patent No.: US 7,281,988 B2
(45) Date of Patent: Oct. 16, 2007

(54) VIBRATION-ABSORBING WEIGHT SYSTEM FOR GOLF CLUB HEAD

(75) Inventor: Wen-Ching Hou, Kaohsiung (TW)

(73) Assignee: Nelson Precision Casting Co., Ltd., Kaohsiung (TW)

( * ) Notice: Subject to any disclaimer, the term of this patent is extended or adjusted under 35 U.S.C. 154(b) by 241 days.

(21) Appl. No.: 11/095,472

(22) Filed: Apr. 1, 2005

(65) Prior Publication Data

US 2006/0223652 A1 Oct. 5, 2006

(51) Int. Cl.
*A63B 53/04* (2006.01)

(52) U.S. Cl. ..... 473/326; 473/332; 473/345; 473/350; 473/335

(58) Field of Classification Search ..... 473/324–350
See application file for complete search history.

(56) References Cited

U.S. PATENT DOCUMENTS

| | | | | |
|---|---|---|---|---|
| 1,562,956 | A * | 11/1925 | Guerne | 473/329 |
| 2,163,091 | A * | 6/1939 | Held | 473/338 |
| 3,817,522 | A * | 6/1974 | Simmons | 473/332 |
| 5,064,197 | A * | 11/1991 | Eddy | 473/326 |
| 5,290,036 | A | 3/1994 | Fenton et al. | |
| 5,637,045 | A * | 6/1997 | Igarashi | 473/332 |
| 5,788,587 | A * | 8/1998 | Tseng | 473/326 |
| 6,012,990 | A | 1/2000 | Nishizawa | |
| 6,206,790 | B1 | 3/2001 | Kubica et al. | |
| 6,296,576 | B1 * | 10/2001 | Capelli | 473/326 |
| 6,306,048 | B1 * | 10/2001 | McCabe et al. | 473/333 |
| 6,524,198 | B2 | 2/2003 | Takeda | |
| 6,773,360 | B2 | 8/2004 | Willett et al. | |
| 2004/0166959 | A1 * | 8/2004 | Chen | 473/326 |
| 2005/0096151 | A1 * | 5/2005 | Hou et al. | 473/335 |
| 2005/0197208 | A1 * | 9/2005 | Imamoto | 473/349 |
| 2005/0266931 | A1 * | 12/2005 | Hou et al. | 473/326 |

* cited by examiner

*Primary Examiner*—Sebastiano Passaniti
(74) *Attorney, Agent, or Firm*—Birch, Stewart, Kolasch and Birch, LLP

(57) ABSTRACT

A golf club head includes a body with a striking plate that has a front side for striking a golf ball and a rear side. A vibration-absorbing area is defined behind the striking plate. At least one gas cushion is mounted in the vibration-absorbing area and includes a bladder defining a gas chamber. The bladder is made of an elastomeric material, and the gas chamber is filled with at least one gas to provide the at least one gas cushion with compressibility. The at least one gas cushion includes an engaging section with which at least one weight member is engaged. The at least one weight member and the at least one gas cushion together adjust a center of gravity of the golf club head while absorbing residual vibrations generated as a result of striking a golf ball.

30 Claims, 7 Drawing Sheets

VIBRATION-ABSORBING WEIGHT SYSTEM FOR GOLF CLUB HEAD

BACKGROUND OF THE INVENTION

1. Field of the Invention

The present invention relates to a weight system for a golf club head. In particular, the present invention relates to a vibration-absorbing weight system for a golf club head.

2. Description of Related Art

U.S. Pat. No. 5,290,036 discloses a cavity back iron with vibration damping material in the cavity. As illustrated in FIG. 1 of the drawings, the golf club disclosed in U.S. Pat. No. 5,290,036 comprises a head 100 including a striking face 101 and a back cavity 102, which is substantially filled with polyurethane 200 (or damping material). When striking a golf ball with the golf club, the damping material 200 may absorb residual vibrations and thus improve gripping comfort.

To improve striking accuracy and direction controllability of the golf ball, when the golf ball begins to contact with the striking face 101, the striking face 101 should be rapidly and significantly compressed when subjected to a slight striking momentum, and the striking face 101 should rapidly resume its shape when the golf ball is about to leave the striking face 101, creating a greater restoring force to be imparted to the golf ball. The striking face 101 creates a rearward stress during continuous deformation of the striking face 101, which causes compression of the damping material 200.

However, since the damping material 200 has a low elastic deforming capability, in the beginning of deformation of the striking face 101, the damping material 200 overpresses against the striking face 101 and thus adversely affects the striking effect. Further, from the time of initial contact between the head 100 and the golf ball to the time the ball leaves the head 100, the striking face 101 could not effectively flex rearward to prolong the contact time with the golf ball due to overpressing by the damping material 200. Thus, the damping material 200 fails to provide the best damping effect, and the overall striking effect is significantly affected.

To adjust the center of gravity of a golf club head, it is common to mount at least one weight member to, e.g., a sole of a body of the club head by welding, screwing, press-fitting, etc. Such a design is disclosed in, e.g., U.S. Pat. Nos. 6,012,990; 6,206,790; 6,524,198; and 6,773,360. However, the club head with a weight member has a relatively small damping and provides an unsatisfactory vibration-absorbing effect. The joint area between the weight member and the club head is liable to crack after a period of time of use, leading to generation of odd sounds and even disengagement of the weight member.

OBJECTS OF THE INVENTION

An object of the present invention is to provide a vibration-absorbing weight system for a golf club head that provides a vibration-absorbing area behind the striking plate for receiving at least one gas cushion and at least one weight member, allowing absorption of residual vibrations, adjustment of the center of gravity of the golf club head, and simplification of assembly of the weight member.

SUMMARY OF THE INVENTION

A golf club head in accordance with the present invention comprises a body including a striking plate that has a front side for striking a golf ball and a rear side. A vibration-absorbing area is defined behind the striking plate. At least one gas cushion is mounted in the vibration-absorbing area and includes a bladder defining a gas chamber. The bladder is made of an elastomeric material, and the gas chamber is filled with at least one gas to provide the at least one gas cushion with compressibility.

The at least one gas cushion includes an engaging section with which at least one weight member is engaged. The at least one weight member and the at least one gas cushion together adjust a center of gravity of the golf club head.

Preferably, the elastomeric material of the bladder is selected from a group consisting of rubber, polyurethane, thermoplastic elastomers, and high-molecular elastomeric resins.

Preferably, a pressure in the gas chamber is equal to, greater than, or smaller than the atmosphere.

Preferably, the at least one weight member has a specific density equal to, greater than, or smaller than that of the body.

Preferably, the at least one weight member is made of a material selected from a group consisting of metal, alloy, plastics, and foaming materials.

In an embodiment of the invention, the bladder of the at least one gas cushion includes a slit through which the at least one weight member is inserted into a receiving space defined by the engaging section of the at least one gas cushion.

In another embodiment of the invention, the bladder of the at least one gas cushion includes at least one coupling section, and the vibration-absorbing area of the body includes at least one coupling section for engaging with the at least one coupling section of the bladder.

In a further embodiment of the invention, the rear side of the body includes a back cavity and a compartment below the back cavity, the back cavity exposing the rear side of the striking plate, the compartment forming the vibration-absorbing area and receiving said at least one gas cushion and said at least one weight member. In an embodiment, the compartment is delimited by the rear side of the striking plate. The compartment is delimited by an area of the rear side of the striking plate that is opposite to a sweet spot of the striking plate, and the at least one gas cushion is in intimate contact with the area of the rear side of the striking plate. Alternatively, the at least one gas cushion is in intimate contact with the rear side of the striking plate at a location opposite to a residual vibration concentrating area of the striking plate. The compartment may be defined in at least one of a heel and a toe of the rear side of the body.

In a further embodiment, the compartment faces rearward, and the engaging section of the at least one gas cushion has a rearward-facing opening such that a portion of the at least one weight member is exposed.

In still another embodiment, the compartment faces upward, and the engaging section of the at least one gas cushion has an upward-facing opening such that a portion of the at least one weight member is exposed.

In yet another embodiment, the compartment faces rearward, and the engaging section of the at least one gas cushion faces the rear side of the striking plate such that the at least one weight member is in contact with the rear side of the striking plate.

In still another embodiment, the compartment faces rearward and the at least one gas cushion includes a side forming the engaging section. The at least one gas cushion and the at least one weight member are mounted in the compartment, with the at least one weight member being in contact with the rear side of the striking plate and with a portion of the at least one weight member being exposed.

In yet another embodiment, a wall delimiting the compartment includes an insertion section to which the at least one weight member is fixed. Preferably, the insertion section is adjacent to the rear side of the striking plate such that a portion of the at least one weight member is in contact with the rear side of the striking plate.

In still another embodiment, the back cavity includes an extension that separates the compartment from the rear side of the striking plate such that the at least one gas cushion is not in direct contact with the rear side of the striking plate.

In yet another embodiment, the body defines a sealed interior space that comprises a compartment in a bottom portion thereof. The compartment forms the vibration-absorbing area and receives the at least one gas cushion and the at least one weight member. Preferably, the compartment is adjacent to the rear side of the striking plate such that the at least one gas cushion is in intimate contact with the rear side of the striking plate. Preferably, the compartment is delimited by the rear side of the striking plate such that the at least one gas cushion is in intimate contact with the rear side of the striking plate. Preferably, the compartment is delimited by an area of the rear side of the striking plate at a location opposite to a residual vibration concentrating area of the striking plate. Preferably, the compartment is defined in at least one of a heel and a toe of the rear side of the body.

Other objects, advantages and novel features of this invention will become more apparent from the following detailed description when taken in conjunction with the accompanying drawings.

DETAILED DESCRIPTION OF THE PREFERRED EMBODIMENTS

Figure 1:
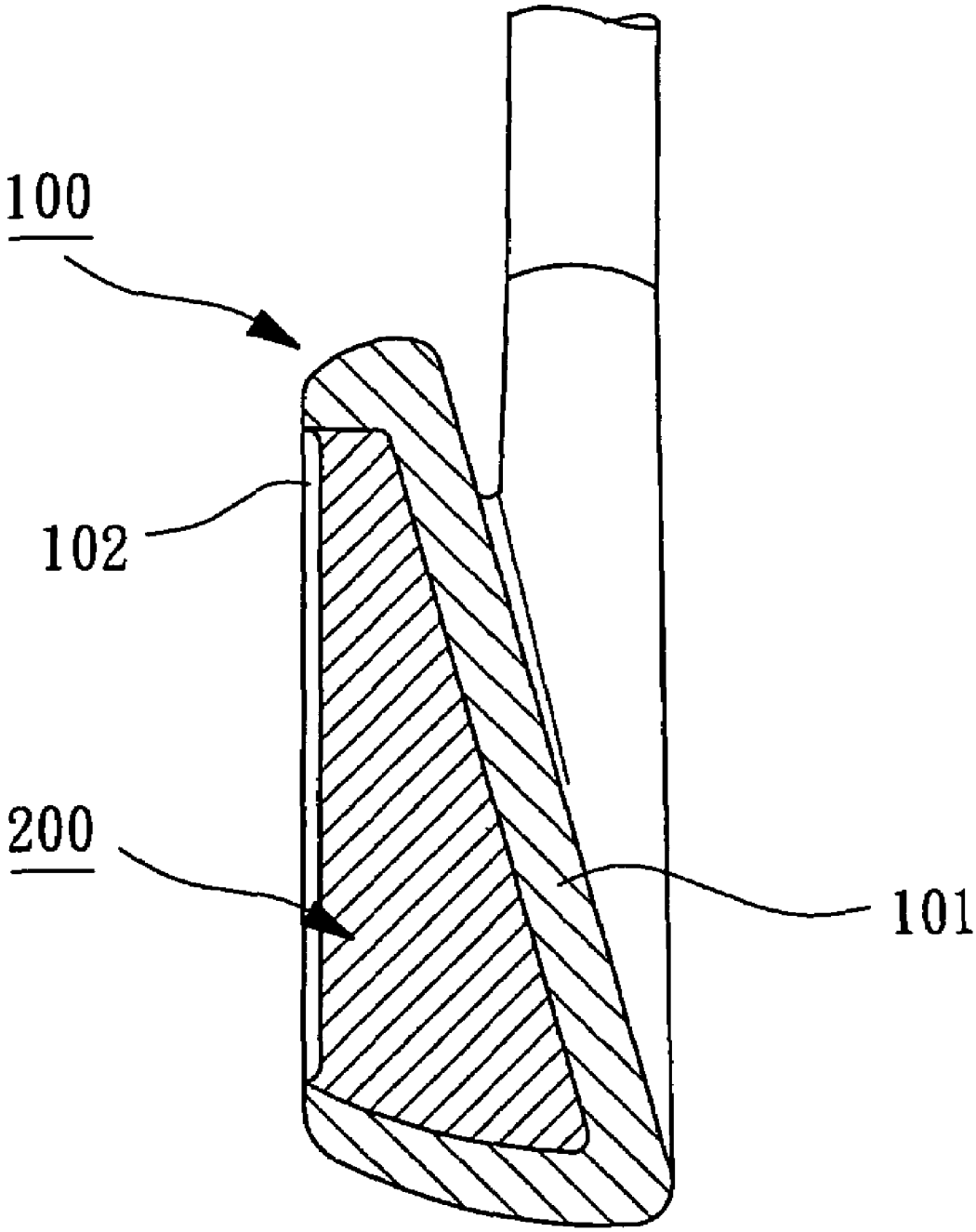
FIG. 1 PRIOR ART
FIG. 1 is a sectional view of a conventional golf club head.
Figure 2:
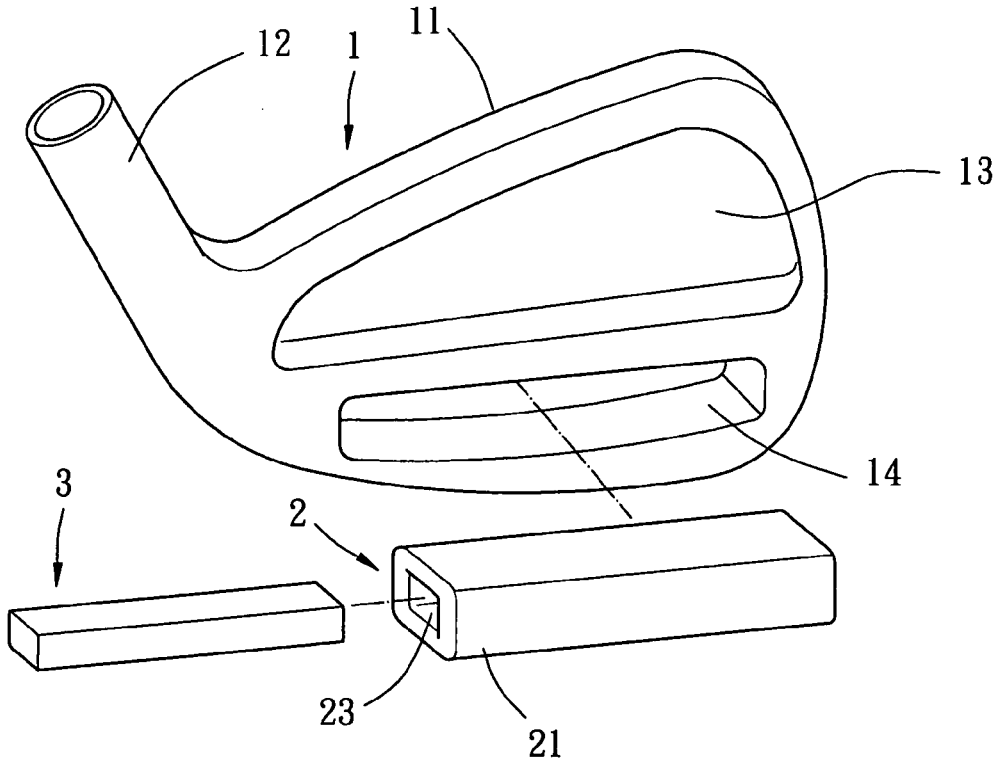
FIG. 2 is an exploded perspective view of a first embodiment of a golf club head in accordance with the present invention.
Figure 3:
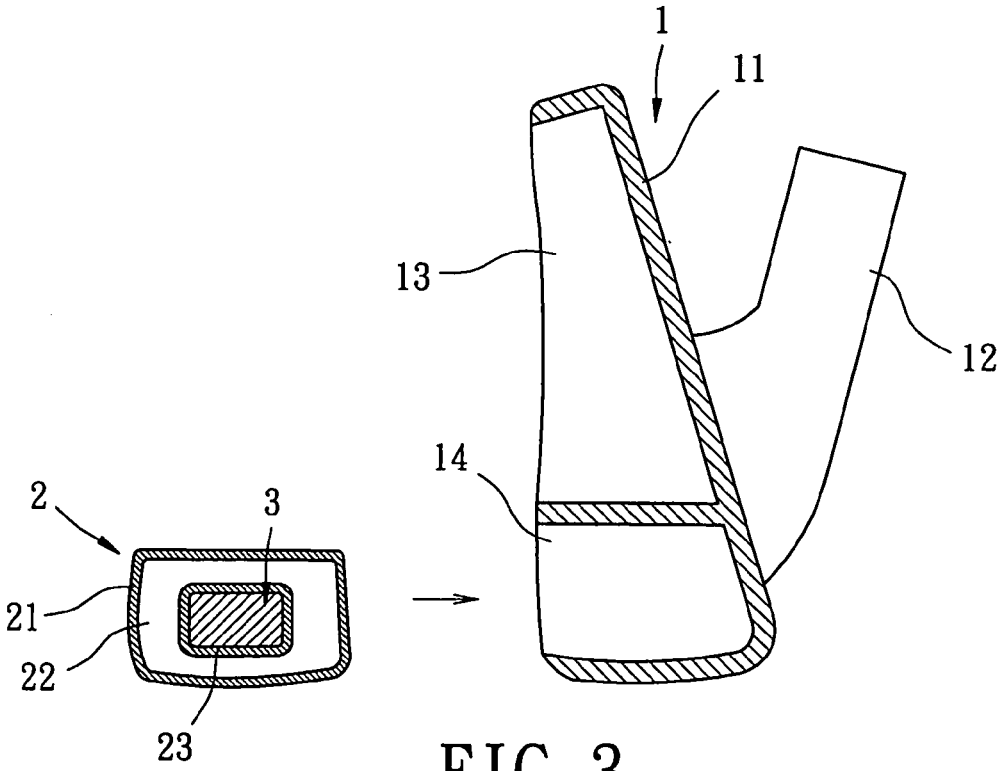
FIG. 3 is an exploded sectional view of the golf club head in FIG. 2.
Figure 4:
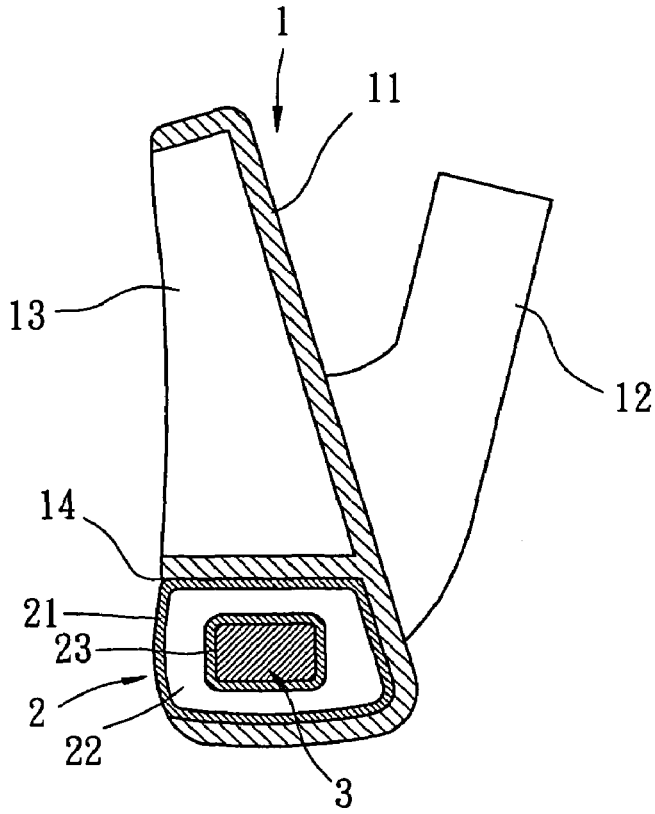
FIG. 4 is a sectional view of the golf club head in FIG. 2.

Referring to FIG. 2 through 4, a first embodiment of a golf club head in accordance with the present invention comprises a body 1, at least one gas cushion 2 (only one in this embodiment), and at least one weight member 3 (only one in this embodiment). The body 1 is a body for an iron club head. The body 1 includes a striking plate 11, a hosel 12, a back cavity 13, and a compartment 14 that provides a vibration-absorbing area. The striking plate 11 can be mounted to the body 1 by welding, brazing, insertion, or screwing. The striking plate 11 has a front side for striking golf balls. Alternatively, the body 1 and the striking plate 11 can be integrally formed with each other, with the striking plate 11 providing a striking face of the body 1 for striking golf balls.

The back cavity 13 is defined in a rear side of the body 1. The rear side of the body 1 is thus exposed to provide a space for rearward deformation of the striking plate 11. The compartment 14 is defined in a bottom or lower portion of the rear side of the body 1 and includes a rearward-facing opening (not labeled). In this embodiment, the compartment 14 is delimited by the rear side of the striking plate 11.

The gas cushion 2 includes a bladder 21 defining a gas chamber 22. Further, the gas cushion 2 includes an engaging section 23 for receiving the weight member 3. The engaging section 23 includes an opening (not labeled) to allow insertion of the weight member 3 into the engaging section 23. In the illustrated embodiment, the engaging section 23 is defined by an inner periphery of the gas cushion 2. The bladder 21 is made of an elastomeric material such as rubber, polyurethane (PU), thermoplastic elastomers, or high-molecular elastomeric resins. Gas and/or liquid are filled into the gas chamber 22. The gas cushion 2 has a specific density smaller than that of the body 1. The pressure in the air chamber 22 may be equal to, greater than, or smaller than the atmosphere.

Still referring to FIGS. 2 through 4, the weight member 3 is made of metal, alloy, plastics, or foaming materials. The weight member 3 has a specific density equal to, greater than, or smaller than that of the body 1.

In assembly, the weight member 3 is inserted into an interior of the engaging section 23 via the opening of the engaging section 23. Next, the gas cushion 2/weight member 3 is inserted into the compartment 14 and bonded by adhesive to a perimeter wall delimiting the compartment 14. Alternatively, the gas cushion 2/weight member 3 is tightly fitted in the compartment 14 by the elasticity of the gas cushion 2. Preferably, the gas cushion 2 is partially in intimate contact with the rear side of the striking plate 11, particularly at an area opposite to the sweet spot.

Since the specific density of the gas cushion 2/weight member 3 is different from that of the body 1, the center of gravity of the golf club head can be adjusted by the gas cushion 2/weight member 3 to improve (or adjust) the inertia moment and striking effect.

During hitting of a golf ball by the golf club head, the golf ball comes in contact with the striking plate 11 at the first stage, results in maximum deformation of the striking plate 11 at the second stage, and leaves the striking plate 11 at the third stage. During each stage of the golf ball, the striking plate 11 deforms rearward and creates a stress pressing against the gas cushion 2, resulting in continuous compression of the gas cushion 2. The volume of the gas cushion 2 changes accordingly.

An appropriate amount of gas is contained in the gas chamber 22, allowing easy elastic compressive deformation when the gas cushion 2 is subjected to a stress. Namely, at the first stage of the golf ball mentioned above, the striking plate 11 begins to elastically deform and imparts a smaller stress to the gas cushion 2, and this stress gradually increases to allow rapid momentary compression of the gas cushion 2.

Thus, the golf club head in accordance with the present invention avoids the gas cushion 2 from overpressing against the striking plate 11 at the first stage, prolonging the contact time between the golf ball and the striking face 11 while assuring the overall striking effect.

At the second stage mentioned above, the striking plate 11 reaches its maximum deformation and creates the maximum stress that compresses the gas cushion 2 to the maximum extent. The gas cushion 2 bears the striking plate 11 and further prolongs the contact time between the golf ball and the striking plate 11, further improving the direction controllability and striking accuracy of the golf ball.

At the third stage mentioned above, the stress from the striking plate 11 gradually reduces to zero. In response, the volume of the gas cushion 2 rapidly resumes its original value. Thus, after the golf ball has been stricken, although a part of momentum is not imparted to the golf ball and thus results in residual vibrations of the striking plate 11, the gas cushion 2 in intimate contact with the rear side of the striking plate 11 effectively absorbs the residual vibrations and thus improves the gripping comfort.

A vibration-absorbing weight system (i.e., gas cushion 2/weight member 3) allowing adjustment of the center of gravity of the golf club head and absorption of vibrations is thus provided.

Figure 5:
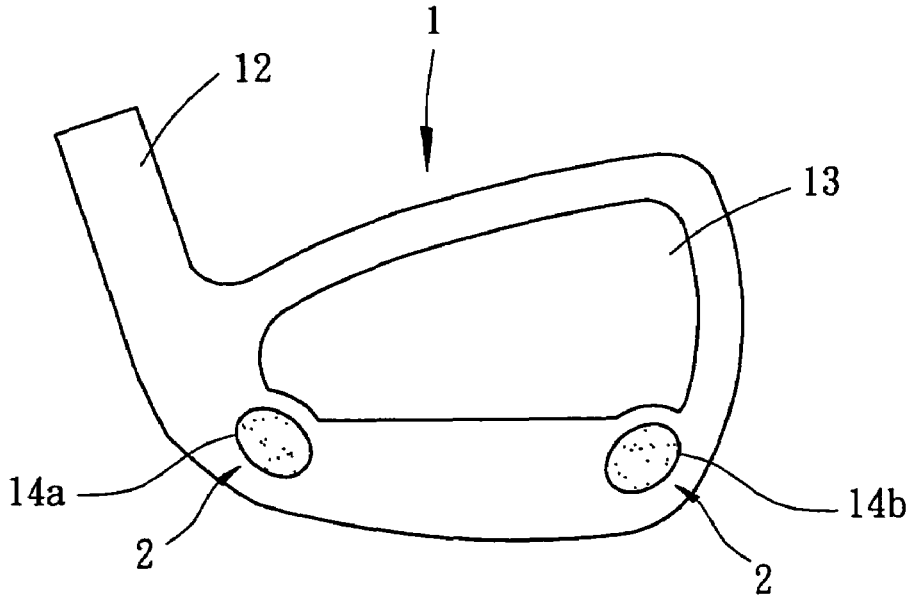
FIG. 5 is a rear side view of a second embodiment of the golf club head in accordance with the present invention.

FIG. 5 illustrates a second embodiment of the invention, wherein the body 1 of the golf club head includes two compartments 14*a* and 14*b* each for receiving a gas cushion 2/weight member 3. In the illustrated embodiment, the compartments 14*a* and 14*b* are defined in the heel and the toe of the rear side of the body 1 that are respectively adjacent to and proximal to the hosel 12. Since the compartments 14*a* and 14*b* are located in an area where the residual vibrations concentrate and since the gas cushions 2 are in intimate contact with the rear side of the striking plate 11, a vibration-absorbing effect is provided while allowing adjustment of the center of gravity as well as improvement (or adjustment) of the inertia moment and the striking effect. Thus, the residual vibrations after striking a golf ball with the golf club head can be effectively absorbed without reducing the momentum. The gripping comfort of the golf club head and the direction controllability and striking accuracy of the golf ball are improved.

Figure 6:
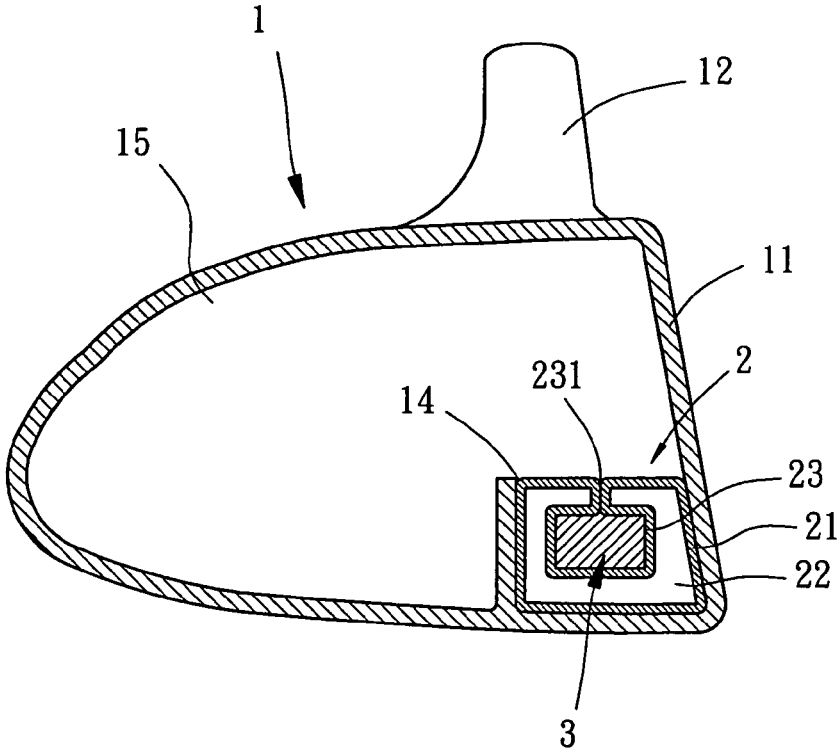
FIG. 6 is a sectional view of a third embodiment of the golf club head in accordance with the present invention.

FIG. 6 illustrates a third embodiment of the invention, wherein the body 1 is of wooden club type and includes a striking plate 11, a hosel 12, and at least one compartment 14 (only one in this embodiment). The compartment 14 is defined in a sealed interior space 15 of the body 1 and adjacent to the striking plate 11. At least one gas cushion 2 (only one in this embodiment) and at least one weight member 3 (only one in this embodiment) are mounted in the compartment 14. The gas cushion 2 includes a bladder 21 defining a gas chamber 22 and an engaging section 23. Further, the gas cushion 2 includes a slit 231 through which a receiving space defined by the engaging section 23 is in communication with outside. The weight is inserted into the receiving space defined by the engaging section 23 via the slit 231, and the gas cushion 2/weight member 3 is then inserted into the compartment 14 of the body 1. The gas cushion 2/weight member 3 allows adjustment of the center of gravity to improve (or adjust) the inertia moment and the striking effect. Thus, the vibrations after striking a golf ball with the golf club head can be effectively absorbed without reducing the momentum. The gripping comfort of the golf club head and the direction controllability and striking accuracy of the golf ball are improved.

Figure 7:
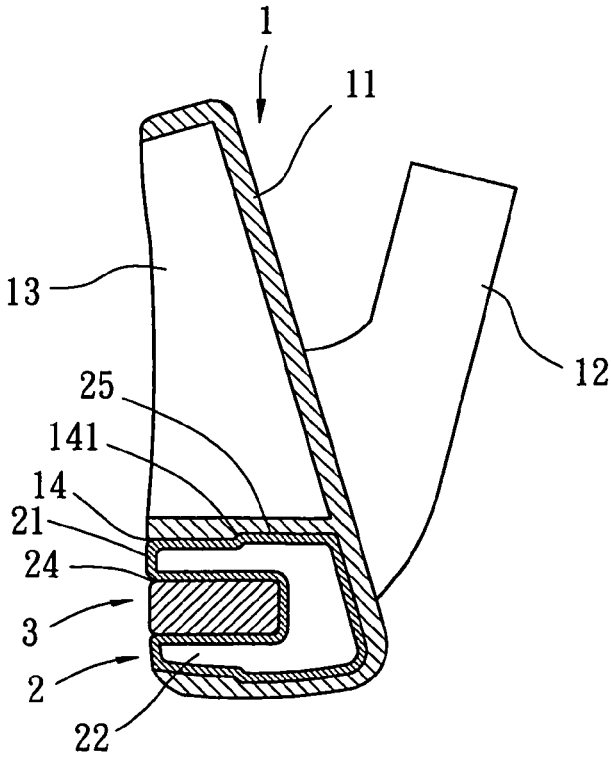
FIG. 7 is a sectional view of a fourth embodiment of the golf club head in accordance with the present invention.

FIG. 7 illustrates a fourth embodiment of the invention, wherein the compartment 14 of the body 1 faces rearward and the gas cushion 2 includes an engaging section 24 providing with a rearward-facing opening (not labeled). The weight member 3 is inserted into the engaging section 24 and has a rearward exposed face (not labeled). This allows easy assembly and detachment of the weight member 3. Further, a trademark, letters, or serial number can be provided on the exposed face of the weight member 3. Further, a wall delimiting the compartment 14 of the body 1 includes at least one coupling section 141 for releasably engaging with at least one coupling section 25 of the gas cushion 2.

Figure 8:
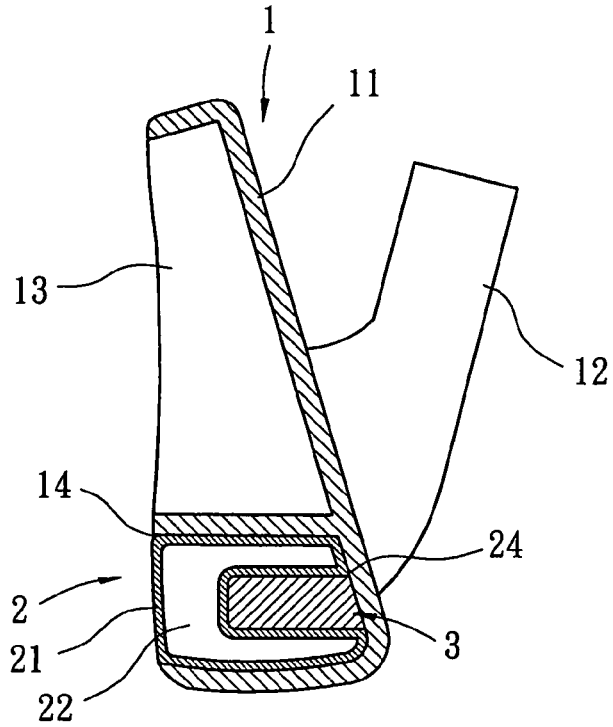
FIG. 8 is a sectional view of a fifth embodiment of the golf club head in accordance with the present invention.

FIG. 8 illustrates a fifth embodiment of the invention, wherein the compartment 14 faces rearward whereas the engaging section 24 of the gas cushion 2 has an opening facing the rear face of the striking plate 11. The weight member 3 is inserted into the engaging section 24 of the gas cushion 2. The weight member 3 can be fixed by welding, bonding, or screwing to the rear side of the striking plate 11 before or after the weight member 3 is inserted into the engaging section 24 of the gas cushion 2.

Figure 9:
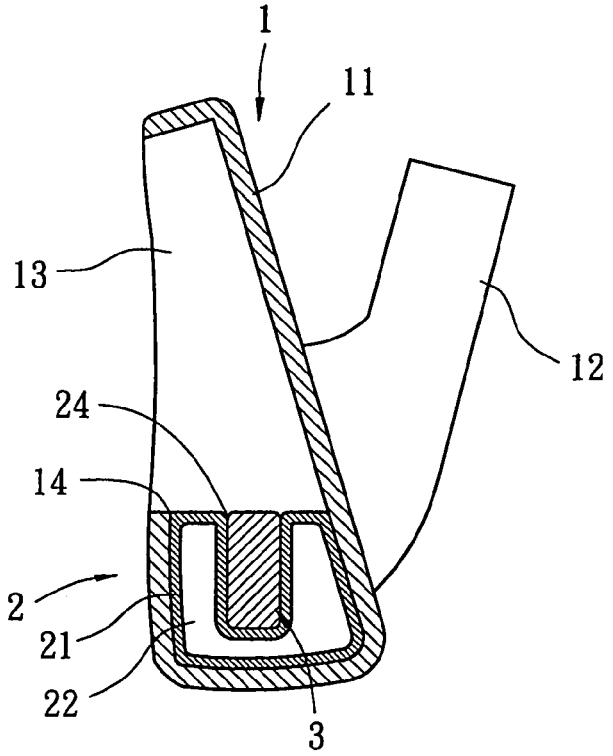
FIG. 9 is a sectional view of a sixth embodiment of the golf club head in accordance with the present invention.

FIG. 9 illustrates a sixth embodiment of the invention, wherein the compartment 14 of the body 1 faces upward and the gas cushion 24 includes an engaging section 24 with an upward-facing opening (not labeled). The weight member 3 is inserted into the engaging section 24 and has an exposed upward face (not labeled). This allows easy assembly and detachment of the weight member 3. Further, a trademark, letters, or serial number can be provided on the exposed face of the weight member 3.

Figure 10:
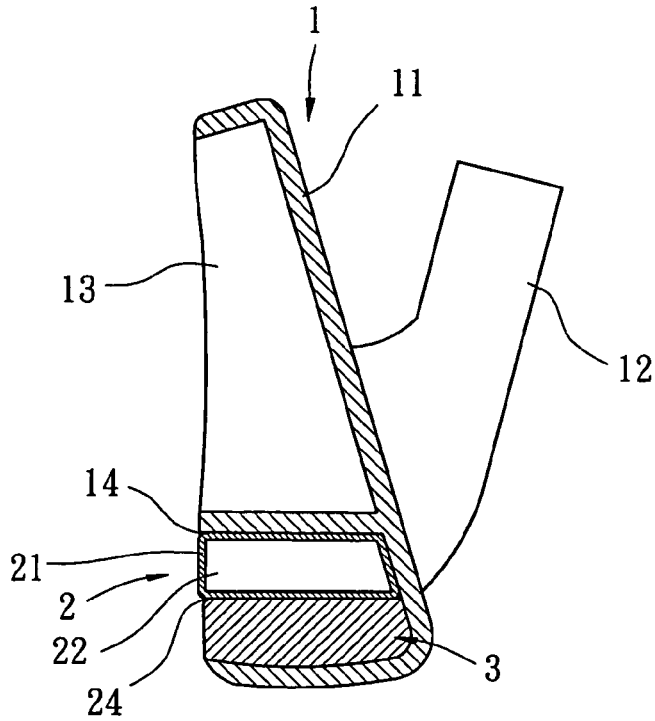
FIG. 10 is a sectional view of a seventh embodiment of the golf club head in accordance with the present invention.

FIG. 10 illustrates a seventh embodiment of the invention, wherein the gas cushion 2 includes a side forming an engaging section 24. The gas cushion 2 occupies a portion of the compartment 14, and the weight member 3 fills the remaining portion of the compartment 14. The assembly and detachment of the weight member 3 can be easily achieved. A trademark, letters, or serial number can be provided on the exposed face of the weight member 3. The weight member 3 can be fixed by welding, bonding, or screwing to the rear side of the striking plate 11.

Figure 11:
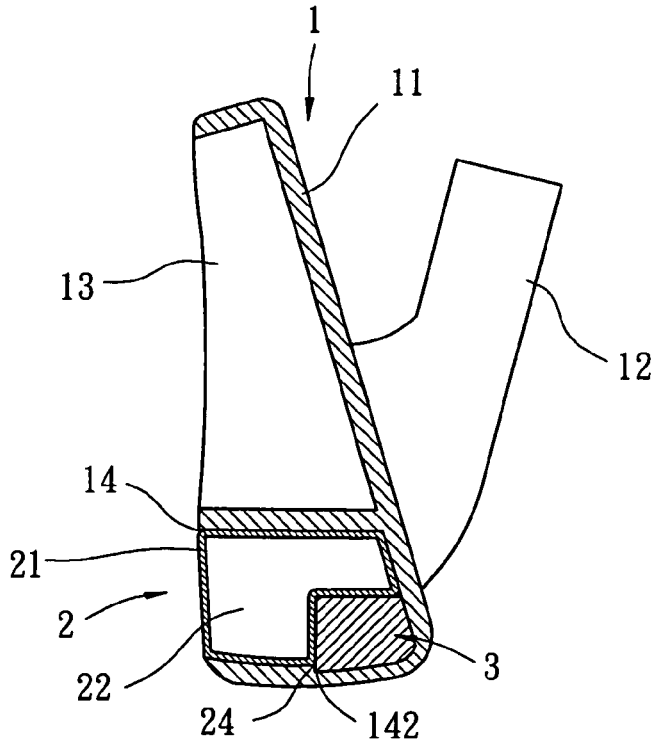
FIG. 11 is a sectional view of an eighth embodiment of the golf club head in accordance with the present invention.

FIG. 11 illustrates an eighth embodiment of the invention, wherein the gas cushion 2 includes a recessed engaging section 24. Further, a ball delimiting the compartment 14 includes an insertion section 142. In assembly, the weight member 3 is fixed by insertion, welding, bonding, or screwing to the insertion section 142 of the compartment 14, and the gas cushion 2 is then inserted into the compartment 14, with the recessed engaging section 24 engaging with the weight member 3.

Figure 12:
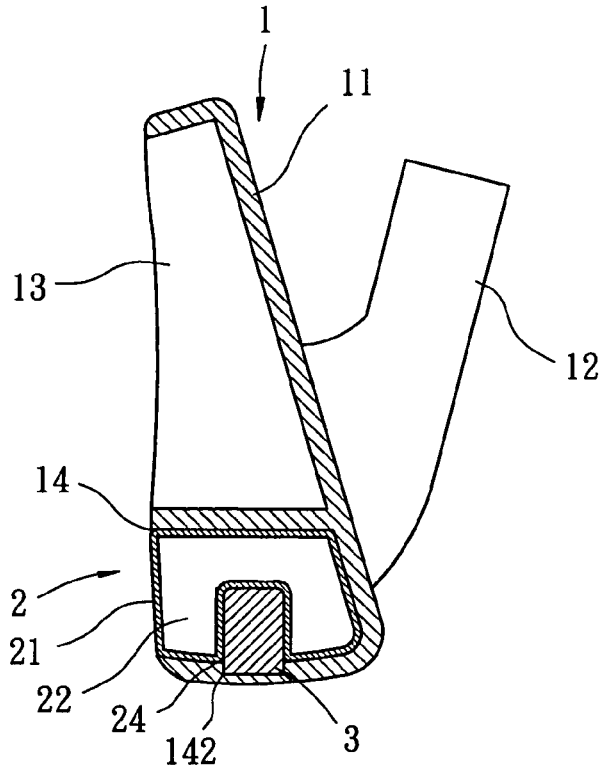
FIG. 12 is a sectional view of a ninth embodiment of the golf club head in accordance with the present invention.

FIG. 12 illustrates a ninth embodiment that is modified from the eighth embodiment. The only difference between the ninth embodiment and the eighth embodiment is the location of the insertion section 142 and the shape of the gas cushion 2.

Figure 13:
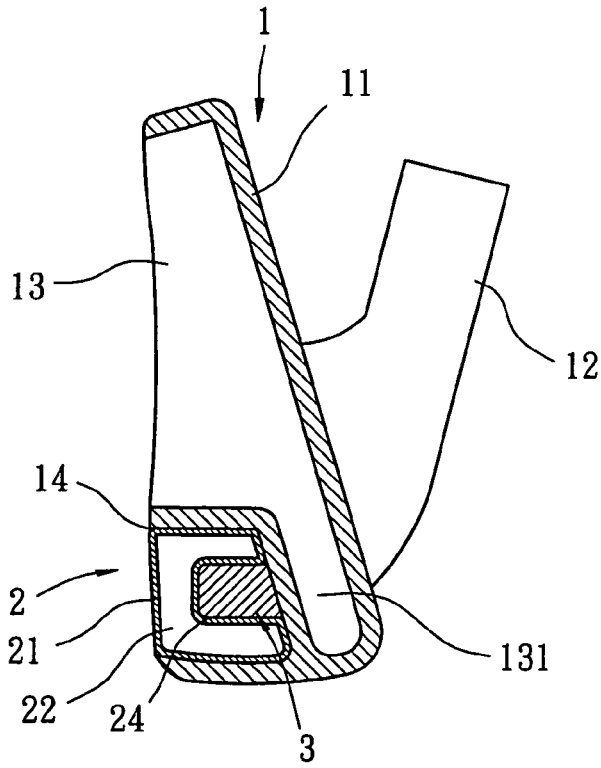
FIG. 13 is a sectional view of a tenth embodiment of the golf club head in accordance with the present invention.

FIG. 13 illustrates a tenth embodiment of the invention, wherein the back cavity 13 of the body 1 has an extension 131 such that the compartment 14 is not delimited by the rear side of the striking plate 11. In other words, the compartment 14 and the striking plate 11 are spaced by the extension 131. The gas cushion 2/weight member 3 mounted in the compartment 14 is thus not in direct contact with the striking plate 11, providing a different vibration-absorbing effect and a different weighting effect to meet different product needs.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A golf club head comprising:

a body including a striking plate, the striking plate including a front side for striking a golf ball and a rear side, a vibration-absorbing area being defined behind the striking plate;

at least one gas cushion mounted in the vibration-absorbing area, said at least one gas cushion including a bladder defining a gas chamber, the bladder being made of an elastomeric material, the gas chamber being filled with at least one gas to provide said at least one gas cushion with compressibility, said at least one gas cushion including an engaging section; and at least one weight member received in and engaged with the engaging section of said at least one gas cushion so as to separate said weight member from the body and, at least one weight member and said at least one gas cushion together adjusting a center of gravity of the golf club head and absorbing vibration while striking a golf ball.

2. The golf club head as claimed in claim 1, wherein the elastomeric material of the bladder is selected from the group consisting of rubber, polyurethane, thermoplastic elastomers, and high-molecular elastomeric resins.

3. The golf club head as claimed in claim 1, wherein a pressure in the gas chamber is equal to, greater than, or smaller than atmospheric pressure.

4. The golf club head as claimed in claim 1, wherein said weight member has a specific density equal to, greater or smaller than that of the body.

5. The golf club head as claimed in claim 1, wherein said at least one weight member is made of a material selected from the group consisting of metal, alloy, plastics, and foaming materials.

6. The golf club head as claimed in claim 1, wherein the bladder of said at least one gas cushion includes a slit through which said at least one weight member is inserted into a receiving space defined by the engaging section of said at least one gas cushion.

7. The golf club head as claimed in claim 1, wherein the bladder of said at least one gas cushion includes at least one coupling section, and wherein the vibration-absorbing area of the body includes at least one coupling section for engaging with said at least one coupling section of the bladder.

8. The golf club head as claimed in claim 1, wherein the rear side of the body includes a back cavity and a compartment below the back cavity, the back cavity exposing the rear side of the striking plate, the compartment forming the vibration-absorbing area and receiving said at least one gas cushion and said at least one weight member.

9. The golf club head as claimed in claim 8, wherein the compartment is delimited by the rear side of the striking plate, and wherein said at least one gas cushion is in intimate contact with the rear side of the striking plate.

10. The golf club head as claimed in claim 9, wherein the compartment is delimited by an area of the rear side of the striking plate that is opposite to a sweet spot of the striking plate, and wherein said at least one gas cushion is in intimate contact with the area of the rear side of the striking plate.

11. The golf club head as claimed in claim 9, wherein said at least one gas cushion is in intimate contact with the rear side of the striking plate at a location opposite to a residual vibration concentrating area of the striking plate.

12. The golf club head as claimed in claim 11, wherein the compartment is defined in at least one of a heel and a toe of the rear side of the body.

13. The golf club head as claimed in claim 8, wherein the compartment faces rearward, and wherein the engaging section of said at least one gas cushion has a rearward-facing opening such that a portion of said at least one weight member is exposed.

14. The golf club head as claimed in claim 8, wherein the compartment faces upward, and wherein the engaging section of said at least one gas cushion has an upward-facing opening such that a portion of said at least one weight member is exposed.

15. The golf club head as claimed in claim 8, wherein the compartment faces rearward, and wherein the engaging section of said at least one gas cushion faces the rear side of the striking plate such that said at least one weight member is in contact with the rear side of the striking plate.

16. The golf club head as claimed in claim 8, wherein the compartment faces rearward, said at least one gas cushion including a side forming the engaging section, said at least one gas cushion and said at least one weight member being mounted in the compartment, with said at least one weight member being in contact with the rear side of the striking plate and with a portion of said at least one weight member being exposed.

17. The golf club head as claimed in claim 8, wherein a wall delimiting the compartment includes an insertion section to which said at least one weight member is fixed.

18. The golf club head as claimed in claim 17, wherein the insertion section is adjacent to the rear side of the striking plate such that a portion of said at least one weight member is in contact with the rear side of the striking plate.

19. The golf club head as claimed in claim 8, wherein the back cavity includes an extension that separates the compartment from the rear side of the striking plate such that said at least one gas cushion is not in direct contact with the rear side of the striking plate.

20. The golf club head as claimed in claim 1, wherein the body defines a sealed interior space that comprises a compartment in a bottom portion thereof, the compartment forming the vibration-absorbing area and receiving said at least one gas cushion and said at least one weight member.

21. The golf club head as claimed in claim 20, wherein the compartment is adjacent to the rear side of the striking plate such that said at least one gas cushion is in intimate contact with the rear side of the striking plate.

22. The golf club head as claimed in claim 21, wherein the compartment is delimited by an area of the rear side of the striking plate that is opposite to a sweet spot of the striking plate, and wherein said at least one gas cushion is in intimate contact with the rear side of the striking plate.

23. The golf club head as claimed in claim 21, wherein the compartment is delimited by an area of the rear side of the striking plate at a location opposite to a residual vibration concentrating area of the striking plate.

24. The golf club head as claimed in claim 23, wherein the compartment is defined in at least one of a heel and a toe of the rear side of the body.

25. A golf club head comprising:

a body including at least one vibration-absorbing area;

at least one gas cushion having a first engaging portion and a second engaging portion, said first engaging portion engaged with the vibration-absorbing area of the body; and at least one weight member engaged with said second engaging portion of the gas cushion so as to separate said weight member from the body and to position said weight member in the body such that said gas cushion is capable of attenuating vibration generated from the weight member while striking the golf ball.

26. The golf club head as claimed in claim 25, wherein said body includes a compartment to receive said gas cushion and said weight member so that said first engaging portion of the gas cushion is engaged with the vibration-absorbing area defined in said compartment.

27. The golf club head as claimed in claim 25, wherein said body includes a striking plate and a compartment spaced from said striking plate; wherein said gas cushion and said weight member are received in said compartment so that said compartment separates said gas cushion and said weight member from said striking plate.

28. The golf club head as claimed in claim 25, wherein said body includes a compartment proximate to a sole so that said first engaging portion of the gas cushion is engaged with the vibration-absorbing area defined on the sole for absorbing vibration.

29. The golf club head as claimed in claim 25, wherein said body includes a compartment proximate to a striking plate so that said first engaging portion of the gas cushion is engaged with the vibration-absorbing area defined on the striking plate for absorbing vibration.

30. The golf club head as claimed in claim 25, wherein said first engaging portion of the gas cushion defines an outer surface while said second engaging portion of the gas cushion defines an inner space spaced apart from said first engaging portion, and wherein the weight member is received in said inner space of the gas cushion.

* * * * *